US007517631B2

(12) United States Patent
Ota

(10) Patent No.: US 7,517,631 B2
(45) Date of Patent: Apr. 14, 2009

(54) METHOD FOR MANUFACTURING POLYMERIZED TONER

(75) Inventor: Nobuyasu Ota, Tokyo (JP)

(73) Assignee: Zeon Corporation, Tokyo (JP)

( * ) Notice: Subject to any disclaimer, the term of this patent is extended or adjusted under 35 U.S.C. 154(b) by 0 days.

(21) Appl. No.: 10/792,750

(22) Filed: Mar. 5, 2004

(65) Prior Publication Data

US 2004/0180282 A1 Sep. 16, 2004

(30) Foreign Application Priority Data

Mar. 12, 2003 (JP) ..... 2003-067216

(51) Int. Cl.
*G03G 9/093* (2006.01)
*G03G 9/08* (2006.01)

(52) U.S. Cl. ..... 430/137.11; 430/137.15; 430/137.17

(58) Field of Classification Search ..... 430/137.17, 430/137.15, 137.12, 137.11; 210/297, 329, 210/330, 345
See application file for complete search history.

(56) References Cited

U.S. PATENT DOCUMENTS 5,952,144 A * 9/1999 Hasegawa et al. ..... 430/110.2
6,495,303 B1 * 12/2002 Kanda et al. ..... 430/137.17

FOREIGN PATENT DOCUMENTS

| | | |
|---|---|---|
| JP | 2000-010341 | 1/2000 |
| JP | 2000-310887 | 11/2000 |
| JP | 2002-148860 | 5/2002 |

OTHER PUBLICATIONS

Neufeldt, V., et al., ed. ,*Webster's New World Dictionary*, Third College Edition, Simon & Schuster, Inc., NY (1988), p. 460.*

* cited by examiner

*Primary Examiner*—Janis L Dote
(74) *Attorney, Agent, or Firm*—Kratz, Quintos & Hanson, LLP

(57) ABSTRACT

In a method for manufacturing a polymerized toner, in a washing step after polymerization, colored polymer particles are washed using a continuous pressurizing filter in a circulation washing manner, in which a dispersion containing colored polymer particles obtained in the polymerization step is supplied by pressure to the inlet of the continuous pressurizing filter from a slurry tank that stores the dispersion; the dispersion is filtered in the filter while stirring; the concentrated dispersion is fed back to the slurry tank from the outlet; a washing solution in a quantity equivalent to the quantity of the filtrate filtered by filtration is added to the slurry tank to dilute the filtrate; and the dispersion diluted by the washing solution is circulated in the filter.

12 Claims, 1 Drawing Sheet

METHOD FOR MANUFACTURING POLYMERIZED TONER

BACKGROUND OF THE INVENTION

1. Field of the Invention

The present invention relates to a method for manufacturing a polymerized toner, and more specifically to a method for manufacturing a polymerized toner that has a high quality and excels in the stability of the quality by adopting a washing manner that enables uniform washing efficiency without insufficient washing portion using a relatively simple washing operation, and excels in the reproducibility of the washing efficiency, in a step for washing colored polymer particles after polymerization.

2. Description of the Related Art

In image forming machines such as electrographic or electrostatic copying machines, laser-beam printers and facsimiles, a developer is used for visualizing electrostatic latent images formed on a photoconductive member. The developer contains colored particles (toner) containing a colorant, a charge control agent, a release agent and the like dispersed in a binder resin as the major component thereof.

Toners are roughly divided into pulverized toners obtained by a pulverizing method, and polymerized toners obtained by a polymerization method. In the pulverizing method, a thermoplastic resin are melted and kneaded together with additive components such as a colorant, a charge control agent, and a release agent, and the resulting mixture is pulverized and classified to obtain a pulverized toner as colored resin particles. The pulverized toner has an indeterminate form and a broad particle diameter distribution. Moreover, since fine particles are easily formed by pulverization in the pulverized toner, it is difficult to manufacture a small particle diameter toner having a desired average particle diameter at a high yield.

In the polymerization method, a polymerizable monomer composition containing a polymerizable monomer, a colorant, and other additive components is polymerized in an aqueous dispersion medium to form a polymerized toner as colored polymer particles. In the polymerization method, the formed colored polymer particles are washed, filtered, and dried after polymerization to obtain a polymerized toner.

According to the polymerization method, a spherical polymerized toner with a sharp particle diameter distribution can be manufactured. Also according to the polymerization method, core-shell structure colored polymer particles can be formed by polymerizing a polymerizable monomer for the shell after the polymerization of the polymerizable monomer composition, in the presence of the formed colored polymer particles. If the glass transition temperature of the polymer component constituting the core is lowered, and the glass transition temperature of the polymer component constituting the shell is elevated, a polymerized toner that excels in shelf stability and low-temperature fixing properties can be manufactured. Furthermore, according to the polymerization method, a polymerized toner having a volume average particle diameter of 10 μm or less, or as further smaller particle diameter as 3 to 8 μm, can be easily manufactured. The polymerized toner, can therefore form a high-definition and high-quality image and is suitable also for increasing a printing speed and forming a full-color image.

However, since the polymerized toner is formed as colored polymer particles by polymerizing a polymerizable monomer composition in an aqueous dispersion medium, the surfaces thereof are easily affected by various components dispersed or dissolved in the aqueous dispersion medium. For example, an aqueous medium containing various dispersion stabilizers is generally used as the aqueous dispersion medium, and the dispersion stabilizers adhere on the surfaces of the formed colored polymer particles. Also, a charge control agent for positive charge or negative charge is generally contained in the polymerizable monomer composition to improve the electrostatic properties of the polymerized toner; if the charge control agent has a high polarity, a part thereof is dissolved in the aqueous dispersion medium, and adheres on the surfaces of the formed colored polymer particles.

If various components adhered on the surfaces of the polymerized toner particles are not removed sufficiently and uniformly in the washing step after polymerization, the charge amount distribution of the polymerized toner becomes broad, causing image densities to lower and causing fog easily, especially under high-temperature and high-humidity conditions. For that reason, in the method for manufacturing the polymerized toner, various manners for washing colored polymer particles (polymerized toner particles) formed in the polymerization step have been proposed.

For example, in Japanese Patent Laid-Open No. 2000-10341, there is proposed a method for manufacturing the polymerized toner particles wherein the filtration of colored polymer particles from a liquid medium after polymerization is performed using a filter press. In this manner, the colored polymer particles after filtration are washed with water.

In Japanese Patent Laid-Open No. 2000-310887, there is proposed a method wherein colored polymer particles after suspension polymerization are washed with an acid, dehydrated, and then the colored polymer particles are washed with warm water. In this manner, the colored polymer particles are washed with warm water at a temperature, not lower than 35° C. and not higher than Tg (the glass transition temperature of the colored polymer particles) minus 10 degrees centigrade (Tg-10° C.), dehydrated, and then dried.

Furthermore, in Japanese Patent Laid-Open No. 2002-148860, there is proposed a method for manufacturing a polymerized toner, wherein colored polymer particles after polymerization are filtered from the medium, a washing liquid is added to the filtered colored polymer particles to form a slurry, the colored polymer particles are filtered again from the slurry, and then the filtered colored polymer particles are dried.

However, in the manner for washing colored polymer particles during fixed on a filter medium, since a washing liquid is passed through a cake layer of a certain thickness comprising colored polymer particles, the washing effect may be insufficient or uneven. In the washing manner by repeating dehydration and re-slurry, the operation is extremely complicated, and the installation area of the apparatus becomes inevitably large.

BRIEF SUMMARY OF THE INVENTION

The object of the present invention is to provide an improved method for manufacturing a polymerized toner that has a high quality and excels in the stability of the quality, using a washing manner that enables uniform washing efficiency without insufficient washing portion using a relatively simple washing operation, and excels in the reproducibility of the washing efficiency, in a step for washing colored polymer particles after polymerization.

The present inventors repeated studies to achieve the above-described object, and found that uniform washing efficiency can be performed without insufficient washing portion, since, by the method in which the dispersion containing colored polymer particles formed in the polymerization step is subjected to circulation washing using a continuous pressurizing filter of a special structure, it is possible to wash the colored polymer particles in a dispersed state in a liquid and to remove the filtrate out of the system to enable washing with a new washing liquid.

In the method for manufacturing a polymerized toner, by the above-described method in the washing step, a polymerized toner that has a high quality and excels in the stability of the quality can be manufactured. In this washing step, when circulation washing is performed while monitoring the electric conductivity of the filtrate, washing that excels in the reproducibility of the washing efficiency can be carried out. The present invention was completed on the basis of these findings.

According to the present invention, there is provided a method for manufacturing a polymerized toner comprising Step 1 for polymerizing colored polymer particles including a step for polymerizing a polymerizable monomer composition containing at least a colorant and a polymerizable monomer in an aqueous dispersion medium;

Step 2 for washing the colored polymer particles; and Step 3 for recovering the colored polymer particles by filtering and drying, wherein in the Step 2, the colored polymer particles are washed (1) using a continuous pressurizing filter furnished with (A) a drum having an inlet of a dispersion and an outlet of the dispersion concentrated by filtration, (B) stirring means comprising a plurality of stirring plates rotatably supported by a shaft of the drum and, fixed to the shaft driven and rotated by a motor along the axial direction at a predetermined interval, and (C) filtering means comprising a plurality of filter plates mounted on an internal wall of the drum so as to be arranged alternately with the stirring plates at an adequate interval from each other in the axial direction and having a hole through which the shaft is passed; and having a structure for putting the filtrate out through the filtering plates; and (2) in a circulation washing manner in which a dispersion containing colored polymer particles obtained in the Step 1 is supplied by pressure to the inlet of the continuous pressurizing filter from a slurry tank that stores the dispersion;

the dispersion is filtered in the continuous pressurizing filter while stirring;

the concentrated dispersion is fed back to the slurry tank from the outlet;

a washing solution in a quantity equivalent to the quantity of the filtrate filtered by filtration is added to the slurry tank to dilute the filtrate; and the dispersion diluted by the washing solution is circulated in the continuous pressurizing filter.

DETAILED DESCRIPTION OF THE INVENTION

Figure 1:
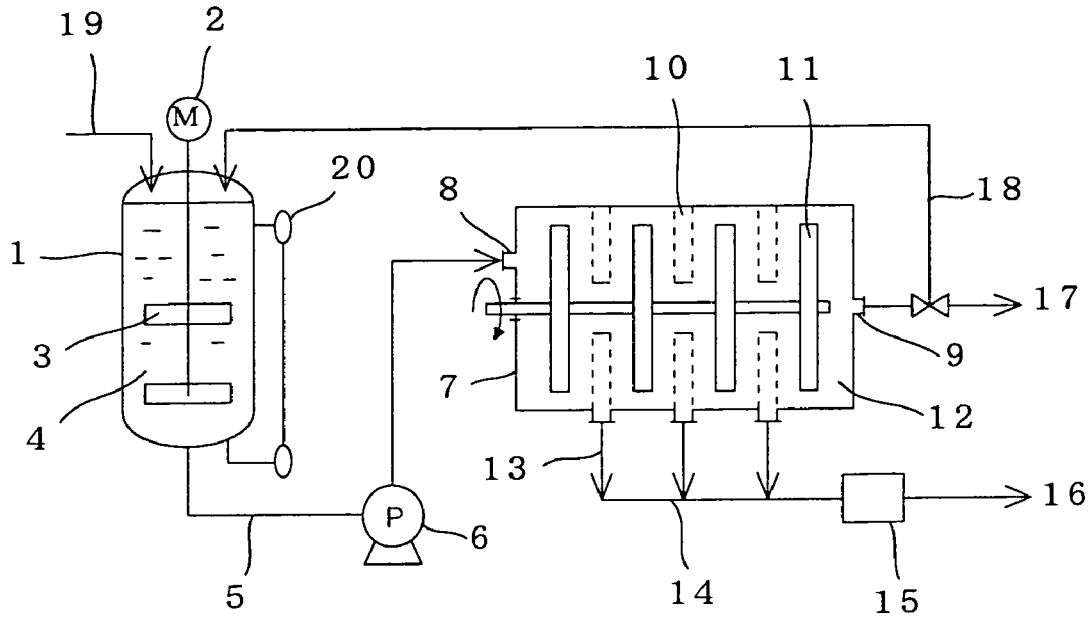
FIG. 1 is a schematic diagram showing an example of a washing system using a continuous pressurizing filter adopted in the manufacturing method of the present invention.

1. Step 1 for Polymerizing Colored Polymer Particles

The method for manufacturing a polymerized toner of the present invention includes Step 1 for polymerizing a polymerizable monomer composition containing at least a colorant and a polymerizable monomer in an aqueous dispersion medium to form colored polymer particles. Although the colored polymer particles are formed by polymerizing the polymerizable monomer composition, core-shell structure polymer particles may be formed, if desired, by adding the step for further polymerizing a polymerizable monomer for shell in the presence of the colored polymer particles. As the aqueous dispersion medium, water, such as ion-exchanged water, is generally used; however, a hydrophilic solvent, such as an alcohol, maybe added as desired. The polymerizable monomer composition may contain various additives such as a charge control agent, a release agent, a cross-linking monomer, a macromonomer, a molecular-weight control agent, a lubricant, and dispersion additives, as required.

(1) Polymerizable Monomer

In the present invention, a monovinyl monomer is generally used as the main component of the polymerizable monomer. Examples of monovinyl monomers include aromatic vinyl monomers such as styrene, vinyl toluene and a-methyl styrene; acrylic acid and methacrylic acid; derivatives of acrylic acid or methacrylic acid such as methyl acrylate, methyl methacrylate, ethyl acrylate, ethyl methacrylate, propyl acrylate, propyl methacrylate, butyl acrylate, butyl methacrylate, 2-ethylhexyl acrylate, 2-ethylhexyl methacrylate, cyclohexyl acrylate, cyclohexyl methacrylate, isobonyl acrylate, isobonyl methacrylate, dimethylaminoethyl acrylate, dimethylaminoethyl methacrylate, methacrylamide and methacrylamide; and monoolefin monomers such as ethylene, propylene, and butylene.

Monovinyl monomers can be used alone, or in a combination thereof. Among these monovinyl monomers, an aromatic vinyl monomer alone, the combination of an aromatic vinyl monomer and a derivative of acrylic acid, methacrylic acid, or the like, are preferably used.

If a cross-linking monomer or a cross-linking polymer is used together with a monovinyl monomer, hot-offset properties can be improved. A cross-linking monomer is a monomer having two or more vinyl groups. The specific examples thereof include aromatic divinyl compounds such as divinylbenzene, divinylnaphthalene, and the derivatives thereof; diethylenic unsaturated carbonic esters such as ethylene glycol dimethacrylate, diethylene glycol dimethacrylate, and 1,4-butanediol diacrylate; compounds having two vinyl groups such as N,N-divinylaniline and divinyl ether; and compounds having three or more vinyl groups such as pentaerythritol triallyl ethers and trimethylol propane triacrylate.

A cross-linking polymer is a polymer having two or more vinyl groups in the polymer. The specific examples thereof include esterified compounds obtained by the condensation reaction of: a polymer having two or more hydroxyl groups in a molecule, such as modified polyethylene, modified polypropylene, modified polyesters, and modified or non-modified polyethylene glycol; and an unsaturated carbonic acid monomer, such as acrylic acid and methacrylic acid.

These cross-linking monomers and cross-linking polymers can be used alone, or in a combination thereof. Their proportion used relative to 100 parts by weight of the monovinyl monomer is generally 10 parts by weight or less, preferably 0.01 to 7 parts by weight, more preferably 0.05 to 5 parts by weight, and most preferably 0.1 to 3 parts by weight.

The use of a macromonomer together with the monovinyl monomer is preferable because the balance of the shelf stability at high temperatures and the fixation properties at low temperatures becomes better. The macromonomer is a giant molecule having polymerizable unsaturated carbon-carbon double bonds at the terminals of the molecular chain, and is an oligomer or polymer generally having a number-average molecular weight of 1,000 to 30,000. The number-average molecular weight within the above-described range is preferable because the fixation properties and shelf stability of the polymerized toner can be kept without lowering the melting properties of the macromonomer.

The preferable groups having a polymerizable unsaturated carbon-carbon double bond present at the terminals of the molecular chain of the macromonomer include the acroyl group and the methacroyl group, among which the methacroyl group is preferable from the point of view of the ease of co-polymerization with the monovinyl monomer used. The macromonomer that provides a polymer, by polymerizing alone, having a glass transition temperature higher than the glass transition temperature of a polymer obtained by polymerizing the monovinyl monomer used is preferable.

Specific examples of macromonomers include polymers formed by polymerizing of styrene, styrene derivatives, methacrylic ester, acrylic ester, acryronitrile, methacrylonitrile, and the like, alone or in a combination thereof; and macromonomers having polysiloxane skeletons. Among these, hydrophilic macromonomers are preferable, and polymers formed by polymerizing methacrylic ester alone, acrylic ester alone and a combination thereof are especially preferable.

When a macromonomer is used, its portion used relative to 100 parts by weight of the monovinyl monomer is generally 0.01 to 10 parts by weight, preferably 0.03 to 5 parts by weight, and more preferably 0.05 to 1 part by weight. The portion of the macromonomer within the above-described range is preferable because the shelf stability of the polymerized toner is kept, while the fixation properties are improved.

(2) Colorant

Various pigments and dyes used in the field of toners, such as carbon black and titanium white, can be used as the colorant. Examples of black colorants include pigments and dyes based on carbon black or nigrosin; and magnetic particles such as cobalt, nickel, triirontetroxide, iron manganese oxide, iron zinc oxide, and iron nickel oxide. When carbon black is used, the use of carbon black having a primary particle diameter of 20 to 40 nm is preferable, because a favorable image quality is obtained, and the safety of the toner to the environment is increased. As colorants for color toners, a yellow colorant, magenta colorant, cyan colorant and the like can be used.

As yellow colorants, condensed azo compounds, iso-indolinone compounds, anthraquinone compounds, azo metal complexes, methine compounds, allylamide compounds, and the like can be used. The specific examples include C.I. Pigment Yellow 3, 12, 13, 14, 15, 17, 62, 65, 73, 74, 83, 90, 93, 95, 96, 97, 109, 110, 111, 120, 128, 129, 138, 147, 155, 168, 180, and 181. In addition, Naphthol Yellow S, Hanza Yellow G, C. I. Vat Yellow, and the like are also included.

Examples of magenta colorants include condensed azo compounds, diketopyrrolopyrrole compounds, anthraquinone compounds, quinacridone compounds, basic dye lake compounds, naphthole compounds, benzimidazolone compounds, thioindigo compounds, and perylene compounds. The specific examples include C. I. Pigment Red 2, 3, 5, 6, 7, 23, 31, 48, 48:2, 48:3, 48:4, 57, 57:1, 58, 60, 63, 64, 68, 81, 81:1, 83, 87, 88, 89, 90, 112, 114, 122, 123, 144, 146, 149, 150, 163, 166, 169, 170, 177, 184, 185, 187, 202, 206, 207, 209, 220, 251, and 254. In addition, C. I. Pigment Violet 19 and the like are also included.

Examples of cyan colorants include copper phthalocyanine compounds and the derivatives thereof, anthraquinone compounds, and basic dye lake compounds. Specific examples include C. I. Pigment Blue 1, 2, 3, 6, 7, 15, 15:1, 15:2, 15:3, 15:4, 16, 17, 60, 62, and 66. In addition, phtharocyanine blue, C. I. Vat Blue, and C. I. Acid Blue are also included.

These colorants can be used alone, or in a combination of two or more. The proportion of the colorants to 100 parts by weight of the polymerizable monomer is generally 0.1 to 50 parts by weight, and preferably 1 to 20 parts by weight.

(3) Charge Control Agent

In order to improve the electrostatic properties of polymerized toners, it is preferable that the polymerizable monomer composition contains one or more of various positive or negative charges control agents. Examples of charge control agents include metal complexes of organic compounds having carboxyl groups or nitrogen-containing groups, metal-containing dyes, nigrosin, and charges control resins.

Specific examples of charge control agents include charge control agents such as BONTRON N-01 (charge control agent; manufactured by Orient Chemical Industries, Ltd.), NIGROSIN BASE EX (charge control agent; manufactured by Orient Chemical Industries, Ltd.), SPIRON BLACK TRH (charge control agent; manufactured by Hodogaya Chemical Co. Ltd.), T-77 (charge control agent; manufactured by Hodogaya Chemical Co. Ltd.), BONTRON S-34 (charge control agent; manufactured by Orient Chemical Industries, Ltd.), BONTRON E-81 (charge control agent; manufactured by Orient Chemical Industries, Ltd.), BONTRON E-84 (charge control agent; manufactured by Orient Chemical Industries, Ltd.), BONTRON E-89 (charge control agent; manufactured by Orient Chemical Industries, Ltd.), BONTRON F-21 (charge control agent; manufactured by Orient Chemical Industries, Ltd.), COPY CHARGE NX VP434 (charge control agent; manufactured by Clariant), COPY CHARGE NEG VP 2036 (charge control agent; manufactured by Clariant), TNS-4-1 (charge control agent; manufactured by Hodogaya Chemical Co. Ltd.), TNS-4-2 (charge control agent; manufactured by Hodogaya Chemical Co. Ltd.), LR-147 (charge control agent; manufactured by Japan Carlit), and COPY BLUE PR (charge control agent; manufactured by Clariant); and charges control resins such as quaternary ammonium (salt) group-containing copolymers and sulfonic acid (salt) group-containing copolymers. The proportion of the charge control agent to 100 parts by weight of the polymerizable monomer is generally 0.01 to 10 parts by weight, and more preferably 0.1 to 10 parts by weight.

(4) Release Agent

In order to prevent offset or to improve the release property on hot-roll fixation, the polymerizable monomer composition may contain a release agent. Examples of release agents include polyolefin waxes, such as low-molecular-weight polyethylene, low-molecular-weight polypropylene, and low-molecular-weight polybutylene; natural vegetable waxes, such as candelilla, carnauba, rice, wood wax, and jojoba; petroleum-based waxes, such as paraffin, microcryatalline, and petrolactum, and modified wax thereof; synthetic waxes, such as Fischer Tropsch wax; and multifunctional ester compounds such as pentaerythritol tetramyristate, pentaerythritol tetrapalmitate, and dipentaerythritol hexamyristate. These release agents can be used alone, or in a combination of two or more.

Among these release agents, synthetic waxes, end-modified polyolefin waxes, petroleum-based waxes, and multifunctional ester compounds are preferable. The proportion of the release agent to 100 parts by weight of the polymerizable monomer is generally 0.1 to 50 parts by weight, more preferably 0.5 to 20 parts by weight, and more preferably 1 to 10 parts by weight.

(5) Lubricant and Dispersion Agent

In order to disperse colorants uniformly, the polymerizable monomer composition may contain a fatty acid such as: oleic acid and stearic acid; a metal salt of a fatty acid formed from a fatty acid and a metal such as Na, K, Ca, Mg, and Zn; and a dispersion agent such as silane-based or titanium-based coupling agent; and the like. The proportion of such a lubricant or dispersion agent relative to the weight of the colorants is generally 1/1,000 to 1/1.

(6) Polymerization Initiator

Examples of polymerization initiators for polymerizable monomers include: persulfates such as potassium persulfate and ammonium persulfate; azo compounds such as 4,4'-azobis (4-cyanovaleric acid), 2,2'-azobis {2-methyl-N-(2-hydroxyethyl) propionamide}, 2,2'-azobis (2-amidinopropane) dihydrochloride, 2,2'-azobis (2,4-dimethylvaleronitrile), and 2,2'-azobisisobutyronitrile; and peroxides such as di-t-butyl peroxide, dicumyl peroxide, lauroyl peroxide, benzoyl peroxide, t-butyl peroxy-2-ethylhexanoate, t-hexyl peroxy-2-ethylhexanoate, t-butyl peroxy pivalate, di-isopropyl peroxy dicarbonate, di-t-butyl peroxy isophthalate, 1,1',3,3'-tetramethylbutyl peroxy-2-ethylhexanoate, and t-butyl peroxy isobutylate. Redox initiators prepared by combining these polymerization initiators and reducing agents can also be used.

Among these initiators, it is preferable to select oil-soluble polymerization initiators soluble to the polymerizable monomer used. A water-soluble polymerization initiator can be used together as required. The polymerization initiator is used in the proportion of generally 0.1 to 20 parts by weight, preferably 0.3 to 15 parts by weight and more preferably 0.5 to 10 parts by weight, to 100 parts by weight of the polymerizable monomer.

The polymerization initiator can be added to the polymerizable monomer composition in advance; however, in order to reduce premature polymerization, the polymerization initiator can also be added directly into the suspension, after the completion of the step for forming the droplets of the polymerizable monomer composition, or during the polymerization reaction.

(7) Molecular-Weight Control Agent

It is preferable to use a molecular weight control agent during polymerization reaction. Examples of molecular weight control agents include: mercaptans such as t-dodecyl mercaptan, n-dodecyl mercaptan, n-octyl mercaptan, and 2,2,4,6,6-pentamethylheptane-4-thiol; and halogenated hydrocarbons such as carbon tetrachloride and carbon tetrabromide. Although the molecular weight control agent is generally contained in the polymerizable monomer composition before initiating polymerization, it can also be added during polymerization. The molecular weight control agent is used in the proportion of generally 0.01 to 10 parts by weight, preferably 0.1 to 5 parts by weight, to 100 parts by weight of the polymerizable monomer used.

(8) Dispersion Stabilizer

The colloid of a hardly-water-soluble metal compound is preferably used as the dispersion stabilizer in the present invention. Examples of hardly-water-soluble metal compounds include: sulfates such as barium sulfate and calcium sulfate; carbonates such as barium carbonate, calcium carbonate, and magnesium carbonate; phosphates such as calcium phosphate; metal oxides such as aluminum oxide and titanium oxide; and metal hydroxides such as aluminum hydroxide, magnesium hydroxide, andiron (III) hydroxide. Among these, the colloid of a hardly-water-soluble metal hydroxide is preferable since it can narrow the particle diameter distribution of polymer particles, and the sharpness of images is improved.

Although the forming way of the colloid of a hardly-water-soluble metal hydroxide is not limited to a specific way, it is preferable to use one obtained from the aqueous solution of a water-soluble multivalent metal compound after controlling the pH to 7 or more, and one obtained by a reaction of a water-soluble multivalent metal compound and an alkali metal hydroxide in an aqueous phase is more preferable, as the colloid of the hardly-water-soluble metal compound. It is preferable that the number particle diameter distribution D50 (50% cumulative value of number particle diameter distribution) of the colloid of the hardly-water-soluble metal compound is 0.5 μm or less, and D90 (90% cumulative value of number particle diameter distribution) is 1 μm or less.

The dispersion stabilizer is used in the proportion of generally 0.1 to 20 parts by weight to 100 parts by weight of the polymerizable monomer. If the proportion is too small, sufficient polymerization stability is difficult to achieve, and polymerization aggregations are easily formed. On the contrary, if the proportion is too large, the viscosity of the aqueous solution becomes too high, and polymerization stability is lowered.

In the present invention, other dispersion stabilizers such as a water-soluble polymer can also be used as required. Examples of water-soluble polymers include polyvinyl alcohol, methylcellulose, and gelatin. In the present invention, although the use of a surfactant is not required, it can be used for stable conduct of suspension polymerization as long as the environment dependence of electrostatic properties of the resultant toner is not enlarged.

(9) Polymerization Step

The polymerized toner is composed of colored polymer particles in which a colorant and additives such as a charge control agent and release agent are dispersed in a polymer binder resin formed by the polymerization of a polymerizable monomer. By using the colored polymer particle as a core, and forming a shell composed of a polymer layer thereon, a core-shell structure polymer particle can be formed.

The polymerized toner can be obtained, for example, through the following steps: mixing a polymerizable monomer, a colorant and other additives using a mixer; wet-pulverizing using a media-type wet pulverizing machine (e.g., a beads mill) as required, to prepare a polymerizable monomer composition; then, dispersing the polymerizable monomer composition in an aqueous dispersion medium containing a dispersion stabilizer; and agitating the resulting mixture to form uniform droplets of the polymerizable monomer composition {primary droplets of a volume average particle diameter of about 50 to 1,000 μm). It is preferable that the polymerization initiator is added to the aqueous dispersion medium after the diameter of the droplets has become uniform in the medium in order to avoid premature polymerization.

The polymerization initiator is added to the suspension wherein the droplets of the polymerizable monomer composition are dispersed in an aqueous dispersion medium, and the suspension is further agitated using a high-speed rotating shear-type agitator until the particle diameter of the droplets becomes a small particle diameter close to the particle diameter of the target polymerized toner. The suspension containing droplets with the smallest particle diameter thus obtained {secondary droplets having a volume average particle diameter of about 1 to 12 μm) is put in a polymerization reactor, and suspension polymerization is performed at a temperature generally between 5 and 120° C., and preferably between 35 and 95° C. If the polymerization temperature is too low, the control of polymerization reaction becomes difficult because a polymerization initiator having a high catalytic activity needs to be used. If the polymerization temperature is too high, additives that melt at low temperatures, if contained, are bled on the surface of the polymerized toner particles, and may deteriorate the shelf stability.

The volume average particle diameter and particle diameter distribution of fine droplets of the polymerizable monomer composition affects the volume average particle diameter and particle diameter distribution of the polymerized toner. If the particle diameter of the droplets is too large, formed polymerized toner particles become too large, and the resolution of images lowers. If the particle diameter distribution of the droplets is broad, the fixation temperature of the resulting toner fluctuates, causing defects such as fog and toner filming to occur. Therefore, it is desirable that the droplets of the polymerizable monomer composition are formed so as to be of the same diameter as the diameter of the polymerized toner particles.

The volume average particle diameter of the droplets of the polymerizable monomer composition is generally 1 to 12 μm, preferably 2 to 10 μm, and more preferably 3 to 8 g/m. When a polymerized toner of an especially small particle diameter is to be formed in order to obtain very fine images, the volume average particle diameter of the droplets of the polymerizable monomer composition is preferably 2 to 9 Mm, more preferably 3 to 8 μm, and further preferably 3 to 7 μm. The particle diameter distribution of the droplets of the polymerizable monomer composition (volume average particle diameter/number average particle diameter) is generally 1 to 3, preferably 1 to 2.5, and more preferably 1 to 2. When especially fine droplets are to be formed, the way, wherein an aqueous dispersion medium containing the monomer composition is run through the gap between the rotor, rotating at a high speed, and the baffle, surrounding the rotor and having small holes or comb teeth, is preferable.

One or more of the above-described monovinyl monomers are selected as the polymerizable monomer. In order to lower the fixation temperature of the toner, it is preferable to select a polymerizable monomer or a combination of polymerizable monomers, that can form a polymer with a glass transition temperature (Tg) of 80° C. or below, preferably 40 to 80° C., and more preferably 50 to 70° C. In the present invention, the Tg of the copolymer composing the binder resin is the calculated value (called "calculated Tg") obtained corresponding to the type and the proportion of the polymerizable monomers used.

By suspension polymerization, colored polymer particles, wherein additive components such as a colorant are dispersed in the resulting polymer of polymerizable monomers, are formed. In the present invention, these colored polymer particles can be used as a polymerized toner as is, and a core-shell structure polymer particles can be obtained by further forming a polymer layer on this colored polymer particles and can be used as a capsule toner. This capsule toner can be used for the purpose of improving the shelf stability (anti-blocking properties), low-temperature fixation properties, and melting properties in fixation.

To form the core-shell structure, the above-described colored polymer particles are used as core particles, and polymerizable monomers for the shell are further polymerized in the presence of the core particles to form a polymer layer (shell) on the surface of the core particles. The use of a polymer having the Tg higher than the Tg of the polymer component composing the core particles as the polymerizable monomer for the shell can improve the shelf stability of the polymerized toner. On the other hand, by setting the Tg of the polymer components composing the core particles to be low, the fixation temperature of the polymerized toner can be lowered, and the melting properties can be improved. Therefore, by forming polymer particles of a core-shell structure in the polymerization step, a polymerized toner materializing high-speed printing (copying, printing and the like), full-color printing, and OHP (overhead projector) transmission properties can be obtained.

As the polymerizable monomer for forming core and shell, a preferable monomer can be selected from the above-described monovinyl monomers. The weight ratio of the polymerizable monomer for the core to the polymerizable monomer for the shell is generally 40/60 to 99.9/0.1, and preferably 60/40 to 99.7/0.3, and more preferably 80/20 to 99.5/0.5. If the proportion of the polymerizable monomer for the shell is too small, the effect of improving the shelf stability of the polymerized toner becomes small; and if the proportion is too large, the effect of lowering fixation temperature becomes small.

The Tg of the polymer formed from the polymerizable monomer for the shell alone is generally above 50° C. and 120° C. or below, preferably above 60° C. and 110° C. or below, and more preferably above 80° C. and 105° C. or below. Difference between the Tg of the polymer formed from the polymerizable monomer for the core alone and the Tg of the polymer formed from the polymerizable monomer for the shell alone is preferably 10 degrees or more, more preferably 20 degrees or more, and further preferably 30 degrees or more. In many cases, it is preferable to select the polymerizable monomer for the core that can form the polymer having a Tg of generally 60° C. or below, preferably between 40° C. and 60° C., from the point of view of the balance between fixation temperatures and shelf stability. On the other hand, it is preferable to use the polymerizable monomer for the shell, such as styrene and methyl methacrylate that can form the polymer having a Tg of 80° C. or above alone or in a combination of two or more.

The polymerizable monomer for the shell is preferably added to the polymerization reaction system as droplets smaller than the average particle diameter of the core particles. If the particle diameter of the droplets of the polymerizable monomer for the shell is too large, it becomes difficult to form the polymer layers uniformly around the core particles. In order to form small droplets of the polymerizable monomer for the shell, the mixture of the polymerizable monomer for the shell and an aqueous dispersion medium is subjected to micro-dispersion treatment, for example using an ultrasonic emulsifier, and the obtained dispersion is added to the polymerization reaction system.

Although no micro-dispersion treatment is required in the case where the polymerizable monomer for the shell is a relatively water-soluble monomer having a solubility to water at 20° C. of 0.1% by weight or more (e.g., methyl methacrylate), because the monomer quickly migrates to the surfaces of core particles, micro-dispersion treatment is preferable for forming uniform shells. In the case where the solubility of the polymerizable monomer for the shell to water at 20° C. is less than 0.1% by weight (e.g., styrene), it is preferable to perform micro-dispersion treatment, or to add an organic solvent having solubility to water at 20° C. of 5% by weight or more (e.g., alcohols) to make core particles easily migrate to the surfaces of core particles.

A charge control agent can be added to the polymerizable monomer for the shell. The preferable charge control agents are the same as the charge control agents used in the above-described manufacturing process of core particles, and when used, the proportion of the charge control agent to 100 parts by weight of the polymerizable monomer for the shell is generally 0.01 to 10 parts by weight, and preferably 0.1 to 5 parts by weight.

In order to manufacture a core-shell structure polymerized toner, a polymerizable monomer for the shell and the aqueous dispersion thereof is added to a suspension containing core particles at once, continuously, or intermittently. When the polymerizable monomer for the shell is added, it is preferable to add a water-soluble radical initiator for efficiently forming the shell. If a water-soluble polymerization initiator is added together with the polymerizable monomer for the shell, it is considered that the water-soluble polymerization initiator goes into the vicinity of the outer surfaces of core particles to which the polymerizable monomer for the shell have migrated, and the polymer layers are easily formed on the surfaces of core particles.

Examples of water-soluble radical initiators include persulfates such as potassium persulfate and ammonium persulfate; and azo-based initiators such as 2,2'-azobis {2-methyl-N-(2-ydroxyethyl) propionamide} and 2,2'-azobis {2-methyl-N-(1,1-bis(hydroxymethyl)ethyl) propionamide}. The water-soluble polymerization initiator is used in the proportion of generally 0.1 to 50% parts by weight, preferably 1 to 20% parts by weight to 100 parts by weight of the polymerizable monomer for the shell.

The aver age thickness of the shell is generally 0.001 to 1.0 μm, preferably 0.003 to 0.5 μm and more preferably 0.005 to 0.2 μm. If the thickness of the shell is too large, the fixation properties of the polymerized toner are lowered; if it is too small, the shelf stability of the polymerized toner is lowered. If the core and the shell of the polymerized toner can be observed using an electron microscope, the core particle diameter and the thickness of the shell can be obtained by directly measuring the particle diameter and shell thickness of a particle randomly selected from the photographs; if it is difficult to observe the core and the shell using an electron microscope, the thickness of the shell can be calculated from the core particle diameter and the quantity of the polymerizable monomer used for forming the shell.

2. Washing Step 2

An aqueous dispersion medium containing colored polymer particles (including core-shell structure polymer particles) can be obtained in the Polymerization step 1. The aqueous dispersion medium is used as it is, or after adding ion-exchanged water for controlling the concentration of the colored polymer particles, as the dispersion containing colored polymer particles for the washing step 2 of the present invention. In this stage, in order to make the dispersion stabilizer used soluble and remove it, treatment such as acid washing and alkali washing may be achieved depending on the character of the dispersion stabilizer. For example, when the colloid of a hardly-water-soluble metal hydroxide, such as magnesium hydroxide, is used as a dispersion stabilizer, an acid such as diluted sulfuric acid is generally added to lower the pH of the dispersion and to dissolve the colloid in the aqueous dispersion medium. A monomer removing treatment, such as stripping treatment, can also be achieved in advance.

In the washing step of the present invention, circulation washing is achieved using a special continuous pressurizing filter. The washing manner used in the present invention will be described referring to FIG. 1. FIG. 1 is a schematic diagram of the circulation washing manner using continuous pressurizing filter, including a sectional view showing an example of the filter used in the present invention.

The continuous pressurizing filter preferably used in the present invention is a horizontal filter also known as a rotary filter. The continuous pressurizing filter in FIG. 1 has a structure, wherein a plurality of filter plates 10 and stirring plates 11 are alternately arranged, at narrow intervals, in a filter chamber 12 sealed by a drum 7 of a pressure-resistant structure. The drum 7 is provided with a dispersion inlet 8 and an outlet 9 of the dispersion concentrated by filtration.

In the drum 7, stirring means comprising a plurality of stirring plates 11 is placed, and it is rotatably supported by a shaft of the drum and fixed at a predetermined interval to the shaft, rotatably driven by a motor, along the axial direction thereof. Each stirring plate is preferably star-shaped or vane-shaped one having radial projections from the shaft center toward the internal wall of the drum.

On an internal wall of the drum 7, there is placed filtering means, comprising a plurality of filter plates 10, having a hole through which the shaft is passed, and being mounted so as to be arranged alternately with the stirring plates 11 at an appropriate interval in the axial direction. Each filter plate 10 has a structure, wherein the supports (filter cloth supports) of filter media made of materials such as wire nettings, are generally placed on the both surfaces of plate-like bodies, and the filter media is laid on the supports. The filter plate has filtrate putting out channels for putting the filtrate filtered by the filter medium out of the drum. The filter plates 10 fixed on the internal wall of the drum 7, and the stirring plates 11 fixed to the rotating shaft are alternately arranged in predetermined intervals. The stir ring plates 11 are generally rotated during filtration.

The dispersion 4 containing colored polymer particles obtained in the polymerization step is stored in a slurry tank 1. The slurry tank 1 is equipped with a stirrer 3 connected to a motor 2. The dispersion 4 is stirred with the stirrer 3 to disperse the colored polymer particles uniformly. A washing-liquid introducing line 19 introduces the washing liquid into the slurry tank 1. The slurry tank 1 is equipped with a liquid level gauge 20. According to information of the dispersion level sensed by the liquid level gauge 20, the quantity of the washing liquid introduced through the introducing line 19 can be controlled.

The dispersion 4 in the slurry tank 1 is pressurized and supplied by a liquid supply pump 6 into the continuous pressurizing filter through a dispersion inlet 8 from the line 5. The dispersion moves through the gaps between the stirring plates 11 and the filter plates 10 under a strongly stirred state produced by the stirring plates 11, and is filtered with the filter plates 10. The dispersion concentrated by the filtration of the filtrate is discharged form an outlet 9. The put out dispersion is circulated through the line 18 into the slurry tank 1. In the slurry tank 1, a quantity of the washing liquid equivalent to the quantity of the filtrate filtered is added through the line 19 to dilute the concentrated dispersion. The dispersion diluted by the washing liquid is supplied again into the continuous pressurizing filter.

In this circulation washing manner, the aqueous medium contained in the dispersion initially containing colored polymer particles is replaced with the washing liquid. The colored polymer particles are washed in the suspended state in the liquid. Since the colored polymer particles are thus washed in a state uniformly dispersed in the liquid, washing can be performed uniformly. The aqueous medium intervened between colored polymer particles is replaced with the washing liquid. Since the colored polymer particles are washed in the dispersed state in the liquid, various components adhered on the surface thereof are efficiently washed and removed.

If the polymerized toner of a fine particle diameter is treated with ordinary pressurizing filtration, the filtration capacity lowers due to the choking of the filter medium, and the life of the filter medium is shortened. However, if the above-described continuous pressurizing filter is used, the colored polymer particles form a thin cake layer of a constant thickness on the filter medium of the filter plates 10, and thereafter, the filtration becomes cake filtration, whereby filtration resistance becomes substantially constant, a throughput is kept high for a long period of time, the life of the filter medium is prolonged, and no leakage of the colored polymer particles occurs.

The filtrate filtered by the filter medium is put out of the drum through the filtrate putting out channel provided on the filter plates 10, and the filtrate from each filter plate 10 is introduced through the lines 13 and 14 into an electric conductivity meter 15, and circulation washing can be performed with monitoring the electric conductivity of the filtrate. The filtrate is finally put out through the filtrate exit port 16.

In order to obtain a high-quality polymerized toner that can provide high-quality images even under high-temperature and high-humidity conditions, circulation washing is to be achieved until the electric conductivity of the filtrate becomes preferably 500 μS/cm or below, more preferably between 1 and 300 μS/cm, and further preferably between 5 and 250 μS/cm. By keeping the electric conductivity of the filtrate at a certain level, the polymerized toner having a constant quality can be always manufactured.

If circulation washing is achieved while monitoring the electric conductivity of the filtrate, washing operations can be terminated when electric conductivity reaches a desired value. After the completion of circulation washing, the concentrated dispersion is put out from the outlet 9 of the drum through the cake putting out port 17.

According to the method of the present invention, since colored polymer particles can be washed automatically and efficiently, operations are easier than in conventional methods of repeating dehydration and re-slurry. In addition, according to the method of the present invention, since circulation washing can be terminated when electric conductivity reaches a desired value while monitoring the electric conductivity of the put out filtrate, the reproducibility of the washing efficiency is excellent. Furthermore, according to the method of the present invention, uniform and sufficient washing can be achieved, whereby the polymerized toner that excels in surface properties can be obtained.

The type, air permeability, the spread of filtering area of the filter medium mounted to the filter plates, the rotation speed of the stirring plates, the internal pressure of the filter, the quantity of the washing liquid, the flow rate of the circulating dispersion, and the like, can be appropriately selected depending on the particle diameter of colored polymer particles, the throughput of the dispersion, the size of the continuous pressurizing filter to be used, and the like.

3. Step for Getting the Colored Polymer Particles; Step 3

After the washing step 2, the colored polymer particles are gotten from the dispersion. The getting step of the colored polymer particles can be achieved by dehydration and drying using conventional methods, and the dried colored polymer particles are gotten.

Although the volume average particle diameter of the polymerized toner {including the capsule toner having a core-shell structure) obtained by the manufacturing method of the present invention is not specifically limited, it is generally 1 to 12 μm, preferably 2 to 11 μm, and more preferably 3 to 10 μm. In order to enhance resolution to obtain very fine images, it is especially desired to reduce the volume average particle diameter of the toner to preferably 2 to 9 μm, more preferably 3 to 8 μm.

The particle diameter distribution of the polymerized toner of the present invention, represented by volume average particle diameter (Dv)/number average particle diameter (Dp), is generally 1.7 or less, preferably 1.5 or less, and more preferably 1.3 or less. If the volume average particle diameter of the polymerized toner is too large, resolution is easily lowered. If the particle diameter distribution of the polymerized toner is too large, the proportion of the toner having large particle diameter increases, and resolution is easily lowered.

It is preferable that the polymerized toner of the present invention is substantially spherical, and the sphericity, represented by the ratio of the major axis (dl) to the miner axis (ds), (dl/ds), is preferably 1 to 1.3, more preferably 1 to 1.2. The use of the substantially spherical polymerized toner, as a non-magnetic one-component developer, improves the transfer efficiency of the toner image on the photo conductive member to the transfer medium.

While the polymerized toner of the present invention can be used as the toner component of various developers, the use as a non-magnetic one-component developer is preferable. When the polymerized toner of the present invention is used as a non-magnetic one-component developer, external additives can be added and mixed as required. Examples of the external additives include inorganic particles and organic resin particles acting as fluidizing agents or abrasives.

Examples of the inorganic particles include silicon dioxide (silica), aluminum oxide (alumina), titanium oxide, zincoxide, tin oxide, barium titanate, and strontium titanate. Examples of the organic resin particles include methacrylic ester polymer particles, acrylic ester polymer particles, styrene-methacrylic ester copolymer particles, styrene-acrylic ester copolymer particles, and core-shell structure particles wherein the core is formed of a styrene polymer and the shell is formed of a methacrylic ester copolymer.

Among these, inorganic oxide particles are preferable, and silicon dioxide is especially preferable. The surface of inorganic particles can be subjected to hydrophobicizing treatment, and silicon dioxide particles subjected to hydrophobicizing treatment are especially preferable. Two or more external additives can be used in a combination, and when external additives are used in a combination, it is preferable to use the inorganic particles with different average particle diameters, or inorganic particles and organic resin particles in a combination. The proportion of the external additives is not specifically limited, it is generally 0.1 to 6 parts by weight to 100 parts by weight of the polymerized toner. In order to make the external additive adhere to the polymerized toner, the polymerized toner and the external additive are generally agitated in a mixer such as a HENSCHEL MIXER.

According to the present invention, there is provided a method for manufacturing a high-quality polymerized toner that excels in the stability of the quality, by relatively simple washing operations in the washing step of colored polymer particles after polymerization, using the washing manner that enables uniform washing efficiency without insufficient washing portion, and excels in the reproducibility of washing efficiency.

In conventional liquid passing washing, using a filter press, or cake washing that washes colored polymer particles fixed on the filter medium such as showering washing using a centrifugal filter or a belt filter, the washing efficiency may be small, or uneven washing may occur, since a washing liquid is passed through the cake layer of a certain thickness.

Whereas, according to the method of the present invention, since colored polymer particles are always dispersed uniformly in the liquid, uniform washing can be achieved. Furthermore, according to the producing method of the present invention, washing can be terminated when electric conductivity reaches a desired value while monitoring the electric conductivity of the put coming filtrate, whereby the reproducibility of the washing effect becomes very high.

In addition, although a good washing effect can be obtained by conventional washing to some extent, by repeating dehydration and re-slurry many times, the installation area of the filter is large, and the operation to repeat dehydration and re-slurry is complicated. Whereas, according to the method of the present invention, a high quality washing can be achieved using a relatively simple process without occupying a large installation area of the filter, since circulation washing can be achieved automatically.

EXAMPLES

The present invention is described below in further detail referring to examples and comparative examples, but the present invention is not limited to the following examples. Unless otherwise specified, "part" and "%" indicate mass by weight. Methods for measurements were as follows.

(1) Particle Diameter

The volume average particle diameter (dv), and particle diameter distribution (dv/dp) of the polymerized toner were measured using a MULTISIZER (particle sizing and counting analyzer; manufactured by Beckman Coulter, Inc.). The measurement using the MULTISIZER was conducted under the conditions of: aperture diameter=100 μm, medium=Isoton II, concentration=10% and the number of measured particles=100,000.

(2) Solid Content of Colored Polymer Particle Dispersion

About 2 g of the dispersion of colored polymer particles was taken in an aluminum plate, weighed precisely $W_0$ (g), and laid still in a dryer set at 105° C. for 2 hours. After cooling, the solid matter was weighed precisely $W_1$ (g), and the solid content was calculated using the following equation:

$$\text{solid content (\%)}=(W_1/W_0)\times 100.$$

(3) Moisture Content of Filter Cake

The filter cake after solid-liquid separation was sampled, 2 g of the cake was taken on an aluminum plate, weighed precisely $W_{wet}$ (g), and laid still in a dryer set at 105° C. for 2 hours. After cooling, the solid matter was weighed precisely $W_{dry}$ (g), and the moisture content was calculated using the following equation:

$$\text{moisture content (\%)}=\{(W_{wet}-W_{dry})/W_{wet}\}\times 100.$$

(4) Cleanness of Colored Polymer Particles After Drying

Electric conductivity is used as the index of cleanness. Electric conductivity was measured by the following method. Five grams of colored polymer particles after drying were dispersed in 100 g of ion-exchanged water, having an electric conductivity σ1, to prepare dispersion. After agitating the resulting dispersion for 2 hours, solid matter was filtered, and the electric conductivity of the filtrate σ2 is measured. On the basis of these measured values, the electric conductivity of the colored polymer particles after drying is obtained using the following equation:

$$\text{(electric conductivity of colored polymer particles after drying)}=\sigma 2-\sigma 1.$$

(5) Evaluation of Image Quality

The developer to be tested was placed in the developing unit of a commercially available printer of a non-magnetic one-component developing system (printing speed=24 sheets/min). After laying the printer still for 24 hours in the environment of a temperature of 23° C. and a relative humidity of 50% (N/N environment), continuous printing was achieved in 5% density, solid printing was achieved after continuous printing of 100 sheets, and printing was stopped halfway of the solid printing. The toner of non-image area, present on the photo conductive member after development, was peeled off using an adhesive tape (adhesive tape; manufactured by Sumitomo 3M Ltd.; trade name: SCOTCH MENDING TAPE 810-3-18), and the adhesive tape was stuck on a new copying paper sheet. The whiteness (B) of the copying paper sheet whereon the adhesive tape was stuck was measured using a whiteness meter (manufactured by Nippon Denshoku Industries, Ltd.). The whiteness (A) of a copying paper sheet whereon only the adhesive tape was stuck was measured in the same manner. The difference of whiteness between these two sheets (A-B) was calculated as the fog value.

Example 1

(1) Step for Preparing Polymerizable Monomer Composition for Core

A polymerizable monomer for the core comprising 80.5 parts of styrene and 19.5 parts of n-butyl acrylate (Tg of the copolymer obtained by copolymerizing these monomers=55° C.), 0.3 part of polymethacrylic acid ester macromonomer (manufactured by Toagosei Co., Ltd.; trade name: AA6; Tg=94° C.), 0.5 part of divinyl benzene, 1.2 parts of t-dodecyl mercaptan, 7 parts of carbon black (manufactured by Mitsubishi Chemical Corporation; trade name: #25), 1 part of a charge control agent (manufactured by Hodogaya Chemical Co., Ltd.; trade name: SPIRON BLACK TRH), and 2 parts of a release agent (Fischertropsh wax, manufactured by Sasol; trade name: PARAFLINT SPRAY 30; endoergic peak temperature: 100° C.) were wet pulverized using a media-type wet pulverizing machine to prepare a polymerizable monomer composition for the core.

(2) Step for preparing aqueous dispersion medium To an aqueous solution, prepared by dissolving 6.5 parts of magnesium chloride (water-soluble multivalent metal salt) in 200 parts of ion-exchanged water, an aqueous solution, prepared by dissolving 5.0 parts of sodium hydroxide (alkali metal hydroxide) in 50 parts of ion-exchanged water, was slowly added while stirring, to prepare a dispersion of magnesium hydroxide colloid (hardly-water-soluble metal hydroxide colloid). The particle diameter distribution of the above-described generated colloid was measured using a micro-track particle diameter distribution measuring instrument {manufactured by Nikkiso Co., Ltd.), and the D50 (50% cumulative value of number particle diameter distribution) and D90 (90% cumulative value of number particle diameter distribution) were 0.35 μm and 0.84 μm, respectively. The measurement using the micro-track particle diameter distribution measuring instrument was achieved under the conditions of a measuring range of 0.12 to 704 μm, a measuring time of 30 seconds, and a medium of ion-exchanged water.

(3) Step for Preparing Aqueous Dispersion of Polymerizable Monomer Composition for Shell Three parts of methyl methacrylate (Tg of the homopolymer=105° C.) and 100 parts of water were micro-dispersed with an ultrasonic emulsifier to prepare an aqueous dispersion of a polymerizable monomer for shell. The particle diameter of the droplet of the polymerizable monomer for the shell was measured by adding the obtained droplets to a 1% aqueous solution of sodium hexametaphosphate to a concentration of 3%, using a micro-track particle diameter distribution measuring instrument, and D90 was 1.6 μm.

(4) Step for Forming Droplets

The polymerizable monomer composition for the core prepared in the step (1) was fed into the aqueous dispersion medium, containing magnesium hydroxide colloid prepared in the above-described step (2), and was agitated until droplets were stabilized. After adding 6 parts of t-butyl peroxy-2-ethylhexanoate (manufactured by NOF Corporation; trade name: PERBUTYL O) to this dispersion as a polymerization initiator, the dispersion was agitated under high shearing force using a high shear agitator (manufactured by Ebara Corporation, trade name: EBARA MILDER) at a rotating speed of 15,000 rpm for 30 minutes to form fine droplets of the polymerizable monomer composition for the core in the aqueous dispersion medium. Thus, the aqueous dispersion wherein the droplets of the polymerizable monomer composition for the core were dispersed was prepared.

(5) Polymerization Step

The aqueous dispersion, wherein the droplets of the polymerizable monomer composition for the core were dispersed, prepared in the step (4), is poured into a reactor equipped with stirring blades, and the temperature was raised to 85° C. to initiate polymerization reaction. The polymerization reaction was continued until the polymerization conversion rate reached almost 100%. At that time, an aqueous dispersion wherein 0.3 part of a water soluble initiator (manufactured by Wako Pure Chemical Industries, Ltd.; trade name: VA-086; 2,2'-azobis {2-methyl-N-(2-hydroxyethyl)-propionamide}) was dissolved in the aqueous dispersion of the polymerizable monomer composition for the shell, prepared in the step (3), was added to the reactor. After continuing polymerization reaction for 4 hours, the dispersion was cooled to stop the polymerization reaction, and the dispersion containing the generated core-shell structure polymer particles (hereinafter referred as "colored polymer particle dispersion") was obtained. The solid content of this colored polymer particle dispersion was 27%. Dv50 (50% cumulative value of volume particle diameter distribution) and Dp50 (50% cumulative value of number particle diameter distribution) were 7.43 μm and 6.19 μm, respectively.

(6) Washing Step

Diluted sulfuric acid was added to the above-described colored polymer particle dispersion until the pH became 4 to make magnesium hydroxide, on the surfaces of the colored polymer particles, soluble in water. The solid content of the colored polymer particle dispersion at that time was 21.5%.

A continuous pressurizing filter as shown in FIG. 1 (manufactured by Kotobuki Industries, Ltd.; trade name: ROTARY FILTER RF-21) was provided, and a filter medium (airflow quantity: 1 cc/sec/cm$^2$; material: polyester; weave: plain) was mounted on this filter. Using this continuous pressurizing filter, the above-described colored polymer particle dispersion was circulation washed under the conditions described below, and the washing operation was stopped when the electric conductivity of the filtrate became 205 μS/cm. Thus, a washed colored polymer particle dispersion of a solid content of 21% was obtained.

Conditions of continuous pressurizing filter were: filter area: 0.17 m$^2$;

rotating speed of stirring plates: 1,150 rpm;

filtering pressure: 0.3 to 0.4 MPa; and washing liquid: ion-exchanged water (electric conductivity=0.4 μS/cm).

The washed colored polymer particle dispersion thus obtained was dehydrated using a siphon-type centrifugal filter (manufactured by Mitsubishi Kakoki Kaisha, Ltd.; trade name: HZ80Si). The electric conductivity of the filtrate at that time was 203 μScm.

Conditions of siphon-type centrifugal filter were:

filter area: 1 m$^2$;

supply quantity of colored polymer particle dispersion: 50 to 60 kg/batch; and centrifugal efficiency: 1,440 G.

The filtered cake thus obtained was vacuum-dried to form colored polymer particle of a volume average particle diameter of 7.48 μm. The obtained colored polymer particles after drying were re-slurried using ion-exchanged water, and the electric conductivity was measured. The above procedures so far of Example 1 were repeated three times, and the electric conductivity of the colored polymer particles after drying was measured. The results are shown in Table 1. The results having very little fluctuation were obtained.

(7) Step for Preparing Non-Magnetic One-Component Developer

To 100 parts of dried colored polymer particles, 0.6 part of hydrophobicizing-treated colloidal silica (manufactured by Nippon Aerosil Co., Ltd.; trade name: RX-300) was added, and the resulting mixture was stirred using a HENSCHEL MIXER to prepare a non-magnetic one-component developer (toner for electronic photography). The results of the evaluation of image quality of the obtained toner are shown in Table 1.

Comparative Example 1

Figure 2:
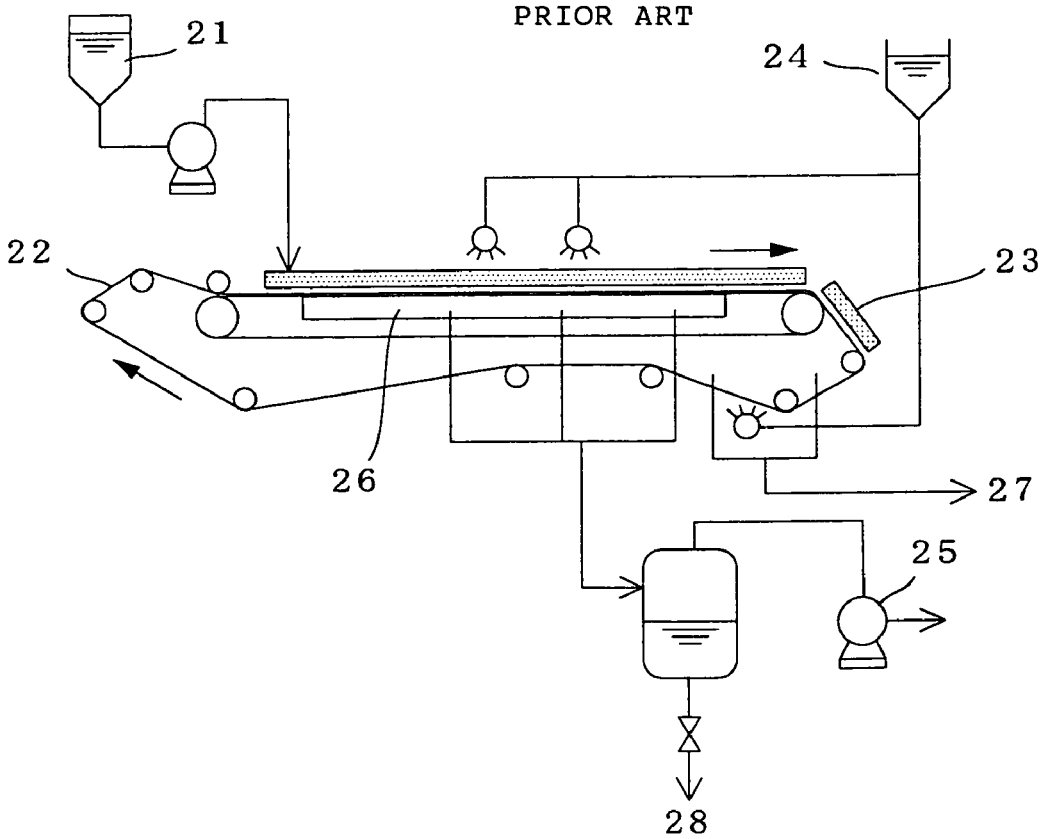
Fig. 2 PRIOR ART
FIG. 2 is a schematic diagram showing an example of a washing system using a conventional horizontal belt-type vacuum filter.

Colored polymer particle dispersion was prepared and washed in the same manner as in Example 1, except a horizontal belt type vacuum filter as shown in FIG. 2 (manufactured by Sumitomo Heavy Industries, Ltd.; trade name: EAGLE FILTER) was used in place of the continuous pressurizing filter.

The material, colored polymer particle dispersion 21, was supplied onto the filter medium (filter cloth) belt 22, and filtered by sucking with a vacuum pan 26 to obtain dehydrated cake 23. The filtrate was sucked with a vacuum pump 25, and put out through the line 28. The wet cake on the belt and the filter cloth belt 22 were washed using a washing liquid 24, and the washing liquid was put out through the line 27.

Filter media (airflow quantity: 1 cc/sec/cm$^2$; material: polyester; weave: plain) was mounted on this filter. Using this filter, the above-described colored polymer particle dispersion was separated under the following conditions, to obtain filtered cake containing colored polymer particles having a water content of 34%. The washing conditions were determined as described below, considering the quantity of the washing liquid to make the electric conductivity of the filtrate, from the centrifugal separator in the following step, about 200 μS/cm, by a preliminary experiment changing the quantity of the washing liquid for the colored polymer particle dispersion.

Conditions of horizontal belt type vacuum filter were:

filter area: 4 m$^2$;

supply speed of colored polymer particle dispersion: 1,800 cm$^3$/hr;

filter cloth (belt) moving speed: 1.2 m/min;

supply speed of washing water: 2,700 cm$^3$/hr; and pressure in vacuum tray: 15 kPa.

The filter cake thus obtained having a water content of 34% was re-slurried with ion-exchanged water so as to have a solid content of 20%, and dehydrated under the same conditions as in Example 1 using the siphon-type centrifugal filter (HZ80Si). The filter cake thus obtained was vacuum-dried to obtain colored polymer particles of a volume average particle diameter of 7.41 μm. The electric conductivity of the dried colored polymer particles obtained here was measured.

The above procedures so far of Comparative Example 1 were repeated three times, and the electric conductivity of the dried colored polymer particles was measured. The results are shown in Table 1. The results had a larger fluctuation than the results of Example 1.

To 100 parts of the colored polymer particles, 0.6 part of hydrophobicizing-treated colloidal silica (RX-300) was added, and mixed using a HENSCHEL MIXER to obtain a non-magnetic one-component developer (toner). The results of the image quality are shown in Table 1.

TABLE 1

| | Example 1 | Comparative |
|---|---|---|
| Electric conductivity of dried particle re-slurry filtrate (μS/cm) | | |
| First run | 106(±0) | 104(±0) |
| Second run | 110(±4) | 193(±89) |
| Third run | 108(±2) | 179(±75) |
| Image quality evaluation (fog value) | | |
| First run | 2.3 | 1.8 |
| Second run | 1.5 | 31.6 |
| Third run | 2.8 | 23.9 |

From the results shown in Table 1, the following was known. According to the present invention, by circulation washing using a continuous pressurizing filter for washing and separating colored polymer particles in the colored polymer particle dispersion, as Example 1 shows, colored polymer particles having the small fluctuation of electric conductivity, which is the index of cleanness after drying, can be formed. Therefore, according to the method for manufacturing the polymerized toner including this washing manner, a high quality toner for electronic photography having a constant quality can be manufactured efficiently and stably.

On the other hand, in Comparative Example 1, even if procedures are achieved under the same conditions as in Example 1, the fluctuation of the electric conductivity after drying is large, and washing may be insufficient. Therefore, the deterioration of image qualities such as fog occurs.

INDUSTRIAL APPLICABILITY

The toner manufactured by the method of the present invention is useful as a toner, a developer, in image forming machines such as electrographic or electrostatic copying machines, laser-beam printers and facsimiles.

What is claimed is:

1. A method for manufacturing a polymerized toner comprising:

(1) forming colored polymer particles including a step for polymerizing a monomer composition containing at least a colorant and a polymerizable monomer in an aqueous dispersion medium, (2) washing said colored polymer particles, and (3) recovering said colored polymer particles by filtering and drying, the colored polymer particles of step (2) being washed in a circulation washing manner using a continuous pressurizing filter for concentrating a dispersion, said filter provided with (A) a drum having an inlet for a dispersion and an outlet for the resulting dispersion concentrated by filtration, (B) stirring means comprising a plurality of stirring plates rotatably supported by a shaft of said drum, the shaft being driven and rotated by a motor along the axial direction, and said plates being fixed to the shaft at a predetermined interval, and (C) filtering means comprising a plurality of filter plates mounted on an internal wall of said drum so as to be arranged alternately with said stirring plates at a predetermined interval from each other in the axial direction, the filter plates having a hole through which the shaft is passed, and having channels through which a filtrate can pass, wherein a dispersion containing colored polymer particles in step (1) is supplied by pressure to the inlet of said continuous pressurizing filter from a slurry tank that stores said dispersion, said dispersion is filtered in said continuous pressurizing filter while stirring thereby forming a concentrated dispersion, the concentrated dispersion is fed back to said slurry tank from said outlet, a washing solution in a quantity equivalent to the quantity of the filtrate obtained by filtration is added to said slurry tank to dilute said concentrated dispersion, with the addition of the washing solution being controlled according to information from a liquid level gauge in the slurry tank, and the dispersion after being diluted by said washing solution is circulated in said continuous pressurizing filter.

2. The manufacturing method according to claim 1, wherein circulating washing is performed in step (2) until the electric conductivity of the filtrate obtained by filtration becomes 500 μS/cm or below.

3. The manufacturing method according to claim 1, wherein said continuous pressurizing filter is a horizontal rotary filter having a plurality of filtering plates and a plurality of stirring plates alternately arranged in a filter chamber sealed by a drum having a pressure-resistant structure.

4. The manufacturing method according to claim 1, wherein said stirring plates are star-shaped or vane-shaped and have radial projections from the center of the shaft toward the internal wall of said drum.

5. The manufacturing method according to claim 1, wherein said filtering plates have a structure upon which supports of filter media is disposed on both surfaces of the structured body, and said filter media is laid on said supports.

6. The manufacturing method according to claim 5, wherein cake filtration is performed by forming cake layers of colored polymer particles on the filter media on the filtering plates, and passing the dispersion through said cake layers in a circulation washing manner.

7. The manufacturing method according to claim 5, wherein said filtering plates are provided with filtrate exiting channels for removing from the drum the filtrate.

8. The manufacturing method according to claim 7, wherein circulation washing manner is performed while monitoring the electric conductivity of the filtrate.

9. The manufacturing method according to claim 1, wherein said colored polymer particles have a volume average particle diameter of 1 to 12 μm, and a particle diameter distribution of 1.7 or below.

10. The manufacturing method according to claim 1, wherein said colored polymer particles have a volume average particle diameter of 3 to 8 μm.

11. The manufacturing method according to claim 1, wherein said colored polymer particles are core-shell structure polymer particles.

12. The manufacturing method according to claim 11, wherein said core-shell structure polymer particles are obtained by polymerizing a monomer composition containing at least a colorant and a polymerizable monomer in an aqueous medium to form colored polymer particles, and further polymerizing a polymerizable monomer for the shell portion in the presence of said colored polymer particles in the polymerization step (1).

* * * * *